US008096901B2

(12) United States Patent
Russotti

(10) Patent No.: US 8,096,901 B2
(45) Date of Patent: Jan. 17, 2012

(54) BASKETBALL TRAINING AID

(76) Inventor: Jeremy Lyle Russotti, Windsor, CA (US)

( * ) Notice: Subject to any disclaimer, the term of this patent is extended or adjusted under 35 U.S.C. 154(b) by 465 days.

(21) Appl. No.: 12/215,111

(22) Filed: Jun. 24, 2008

(65) Prior Publication Data

US 2009/0318248 A1 Dec. 24, 2009

(51) Int. Cl.
*A41D 19/00* (2006.01)

(52) U.S. Cl. ..... 473/450; 2/161.1; 2/162; 2/163; D29/113; D29/114; D29/117.1; D29/123

(58) Field of Classification Search ..... 473/450, 473/205; 2/16, 161.3, 161.4, 163
See application file for complete search history.

(56) References Cited

U.S. PATENT DOCUMENTS 2,769,179 A * 11/1956 Love ..... 2/161.5
D352,134 S * 11/1994 Crowder ..... D29/113

* cited by examiner

*Primary Examiner* — Gene Kim
*Assistant Examiner* — Amir Klayman
(74) *Attorney, Agent, or Firm* — Welsh Flaxman & Gitler LLC

(57) ABSTRACT

A basketball training aid designed to teach a user how to correctly grip, set up, and release a basketball. The device includes a material that wraps around the top (prone side) of the hand and bottom half of the underside (supine side) of the hand, without limiting wrist extension and flexion during a basketball shot. The glove includes a splint support material on top of the index, middle, and ring fingers, running from the middle of the digits to the bottom half of the top (prone side) of hand. The splint support material prevents premature finger flexion at the base of the fingers during the release of the shot, ensuring an open hand at follow through. Additionally, the design encourages proper finger separation and proper extension of wrist joint on set up, keeps the ball off the palm of the hand, and promotes proper position for dribbling a basketball effectively.

10 Claims, 5 Drawing Sheets

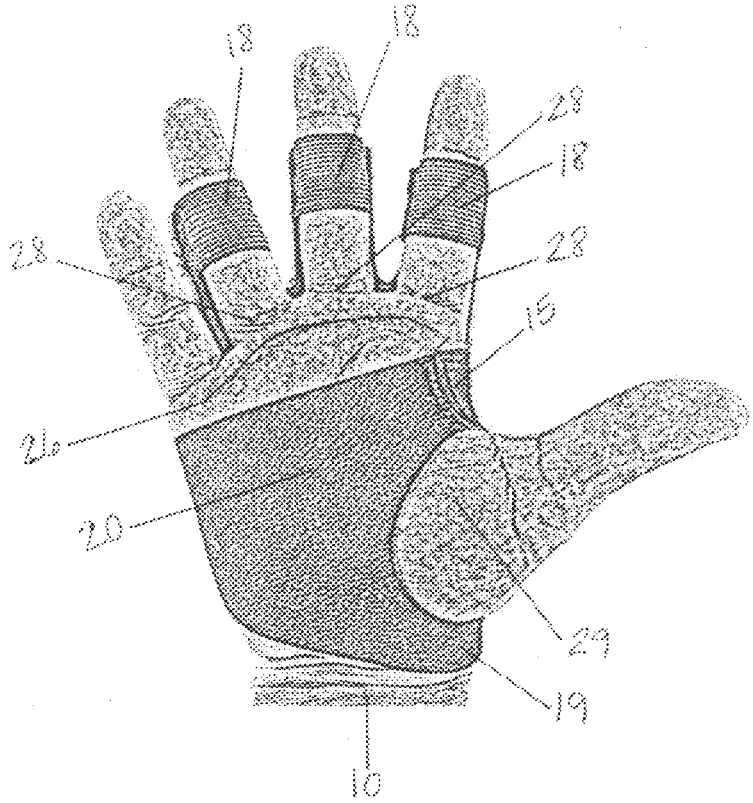
Figure 3
Figure 4
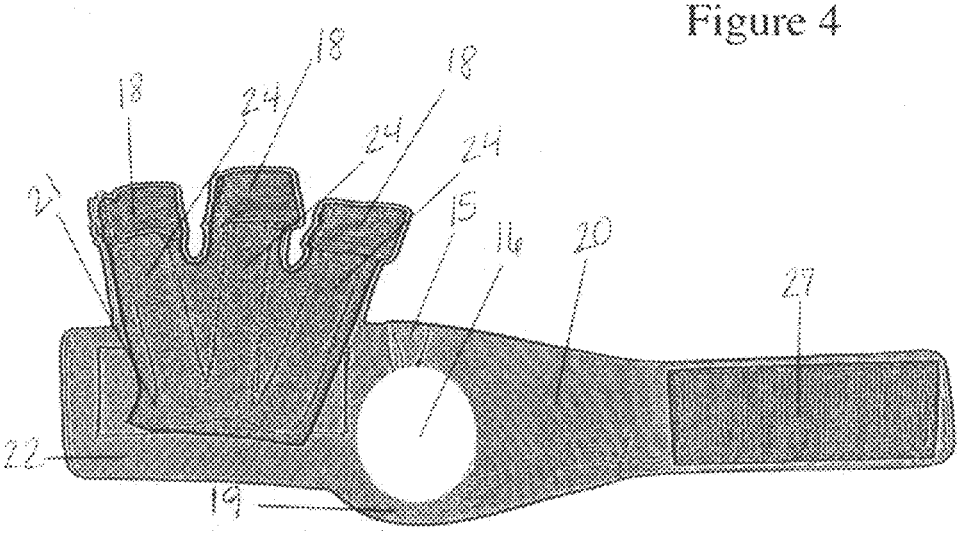

BASKETBALL TRAINING AID

CROSS-REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

The present invention is a basketball hand-training device for improving a person's ability to place their hand in the correct shooting position, as well as finishing with proper follow through. In addition, the invention is used to teach proper hand positioning for maximum efficiency while dribbling the basketball.

Known prior art includes U.S. Pat. Nos. 5,149,085; 4,805,905; 5,833,237; 3,496,573; 5,135,217; 6,729,979; 5,236,190; 5,636,381; US 2007/0270248 A1.

The uses of basketball shooting and dribbling devices posted above are known to consist of familiar, expected and obvious structural configurations, notwithstanding the myriad of designs encompassed by the crowded prior art which have been developed for the fulfillment of countless objectives and requirements. While these devices fulfill their objectives (some more than others), the device I will propose includes objectives which are not anticipated, rendered obvious, suggested, or even implied by any of the prior art for basketball shooting trainers, either alone or in any combination thereof.

BACKGROUND OF THE INVENTION

In the game of basketball, the primary skill that determines the success of a team or individual is the art of proper shooting. Coaches have researched their teaching methods extensively in order to find the correct way to properly shoot a basketball. From amateurs to professionals, using a device that teaches proper biomechanical release of a basketball will result in higher success and excitement for the game of basketball.

Biomechanical movement is directly related to the success of the basketball shot. In order to shoot a basketball for a high percentage, a player needs to use the correct body joints, and muscles attached, together as one unit. Incorporating the least amount of body joints (and muscles) will result in increased muscle memory retention and less chance for biomechanical errors. Past prior art devices unfortunately disregard this important concept, resulting in performance issues regarding the kinetic chain principle of shooting movements.

The most important biomechanical aspect for proper shooting is a proper release at the wrist joint, and the elimination of finger flexion at finger joints. The ability to maintain an open hand at the release of a shot is vital to proper shooting. This will negate the use of the 26 bones (and muscles attached) of a person's hands and fingers during the basketball shot, resulting in a dependence on shooting through the shoulder, elbow, and wrist joints. Negating the finger joints for proper shooting will result in; an increase in muscle memory for shooting success; proper front to back hinging at the wrist joint, without side to side wrist hinging which causes improper ball rotation; improved ball rotation because of proper front to back hinging at wrist joint, and; increased strength or range of a player's basketball shot because of reliance on muscles of larger body joints (elbow, shoulder, and wrist).

Proper hand positioning is another important skill for the proper basketball shot. The ability to stabilize the basketball in hand from start to finish, as the wrist joint hinges forward will result in an increase in performance. The invention proposed includes a device that will allow proper finger separation in order for players to control the basketball from the start of their shot to the finish of their release.

U.S. Pub. No. US 2007/0270248 A1 on Nov. 22, 2007 by Robert French claims to provide maximum separation of shooting fingers as well as to keep the ball off the palm of the hand. However, this device has limitations. The foam material located between the shooter's fingers is unnatural, raising the basketball one inch off the hand, causing the ball to be located too high on the fingers. This results in loss of power since the ball is not located on the finger pads, but rather on the top two digits of the fingers only. Furthermore, removal of the foam device leaves an absence of material to create the affect proposed.

It has been well documented by prior art that the ball should not remain on the palm of the hand in order to create fingertip control. U.S. Pub. No. US 2007/0270248 A1 on Nov. 22, 2007 by Robert French uses a foam material to create this effect. Though very true, once again, it will unnaturally raise the ball too high for reasons mentioned above. Ultimately, this device keeps the ball off the palm of the hand but does not address proper wrist extension during the set-up of a shot. Therefore, keeping the ball off the palm of the hand does not guarantee proper mechanics and efficiency of wrist flexion during the shot release.

U.S. Pat. No. 5,833,237 issued to Strug on Nov. 10, 1998 provides a basketball-gripping device to prevent the basketball ball on the palm of a user's hand. This is achieved by a trapezoid cross-section that straps around the bottom of the hand. The surface of the device is contoured to correspond to the shape of the basketball. This device has limitations in that it does not assist the player in positioning the hand correctly on the ball (with fingers spread apart), but only provides a means of keeping the ball off the palm of the hand. Furthermore, the device does not provide a solution for preventing wrist flexion on the release of a shot.

Another very important critical element to the basketball shot is proper wrist extension on the initial set up for the shot. The increased wrist extension before the release of the shot will result in increased finger control and shot power because of the higher velocity created by wrist joint flexion. Because of years of throwing baseballs as youngsters before shooting a basketball, players tend to shoot with limited wrist bend. My proposed invention improves wrist extension because of the design. The location and firmness of the splint support material above the fingers prevents flexion at the base of the finger joints. If a player tries to shoot a basketball without maximizing wrist bend at that joint, the fingertips will not rest on the basketball. Therefore, a shooter must extend his or her wrist further in order to have his or her index fingers come in contact with the ball. Thus, the device results in perfect hand positioning on every repetition.

U.S. Pat. No. 5,149,085 on Sep. 22, 1992 by Sanchez claims to develop proper positioning and release of the basketball. A strap is connected between two bands (one on wrist and the other around the middle of hand). When the bands stretch to a tension point as the wrist rotates forward, it triggers a sensing mechanism. However, the device is limited, since it does not include any design system to monitor the proper position of wrist extension before the release of the shot, or prevent wrist flexion on the follow through.

A variety of prior art claim to improve a player's ball-handling by keeping the ball away from the palm of their hand for more finger tip control. Although very true, their devices fail to comply with a very effective biomechanical principle of dribbling. While dribbling, one should be able to dribble at high speeds, by repetitively flexing and extending at the wrist joint. However, incorporating the wrist action with the flexion and extension at the base of the finger joints, results in loss of speed and increases in injuries (finger jams). To increase your efficiency and speed of dribbling, a player needs to maintain finger extension through the entire movement. Because of the proposed design system, the glove does not allow finger flexion, while spreading the fingers out properly to allow maximum efficiency when dribbling a basketball.

In reviewing all that has been previously proposed, there appears to be a need for a significantly improved product, which more effectively positions the user in the most advantageous biomechanical position through the entire shot process. This will result in greater success for users, as well as teaching principles for coaches, trainers, and parents.

BRIEF SUMMARY OF THE INVENTION

The primary objective of the invention is to teach proper shooting and ball-handling techniques.

Another objective of the invention is to provide a training aid to reinforce proper biomechanical release techniques on the basketball shot. This includes a device that prevents premature flexion of the base of finger joints. The device will allow the player to keep his or her finger joints extended, which in turn will allow proper kinetic chain release of the shot, while preventing improper hinging of the wrist joint. Furthermore, because the device will always keep the fingers extended, it will greatly increase a player's ball-handling efficiency and form.

A further objective of the invention is to provide ideal finger separation, which will allow the ball to rest on the finger pads and fingertips correctly while remaining in a balanced position on the shot set up. This will also allow maximum balance while gripping a basketball during shot set up.

Another objective of the invention is to position the ball properly on the hand without resting on the palm, without having to add a pad or object that is unnatural to the hand.

Furthermore, another objective is to design the unit to promote proper wrist extension during the set up of the shot. This will greatly increase the power and form of the players who use the device. When wearing the device, one will not be able to grip the basketball properly without maximum extension of the wrist joint. When the glove is being worn and the wrist isn't extended fully, the index finger will not be able to rest on the basketball. Extending the wrist further into proper position will allow the index finger to rest underneath the ball.

Once the wearer has developed the appropriate positioning habits, the shooting aid may be removed, the basketball will feel easier to grip or otherwise handle with the hand that previously had been wearing the device.

BRIEF DESCRIPTION OF THE DRAWINGS

FIG. 3 is a bottom view of hand (right) wearing the device.

FIG. 4 is a bottom view of the device spread out its entire length.

DESCRIPTION OF THE PREFERRED EMBODIMENT

Figure 1:
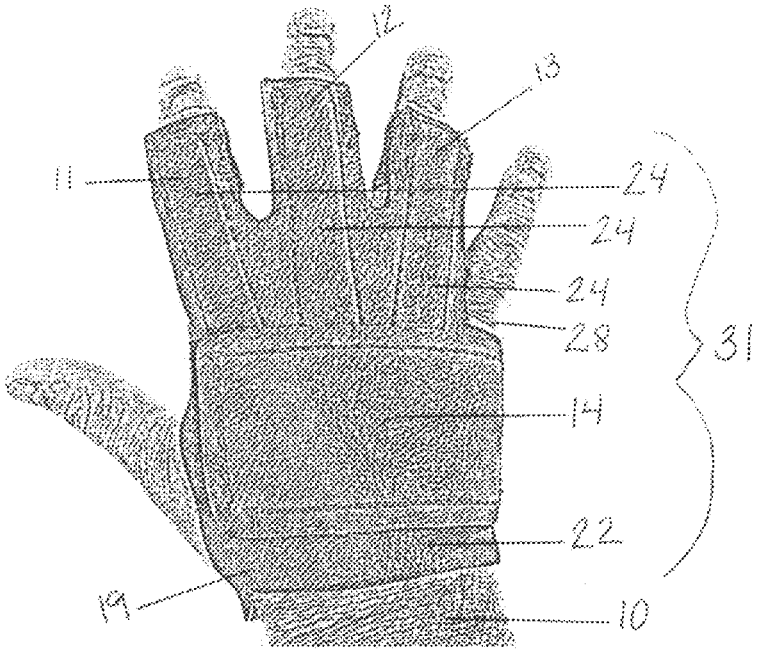
FIG. 1 is a top view of a hand (right) wearing the device.

Referring now to the drawings, FIG. 1 shows the top view of a player wearing the glove 31. The glove covers the top of the hand, from the top of the index finger 11, middle 12, and ring finger 13, to the bottom 22 of the wrist 10. The material can be neoprene, vinyl, naugahyde, or leather applications. The material on the top of the hand, is shaped to contour the correct finger separation position for the fingers 11 12 13 during the shot.

Figure 2:
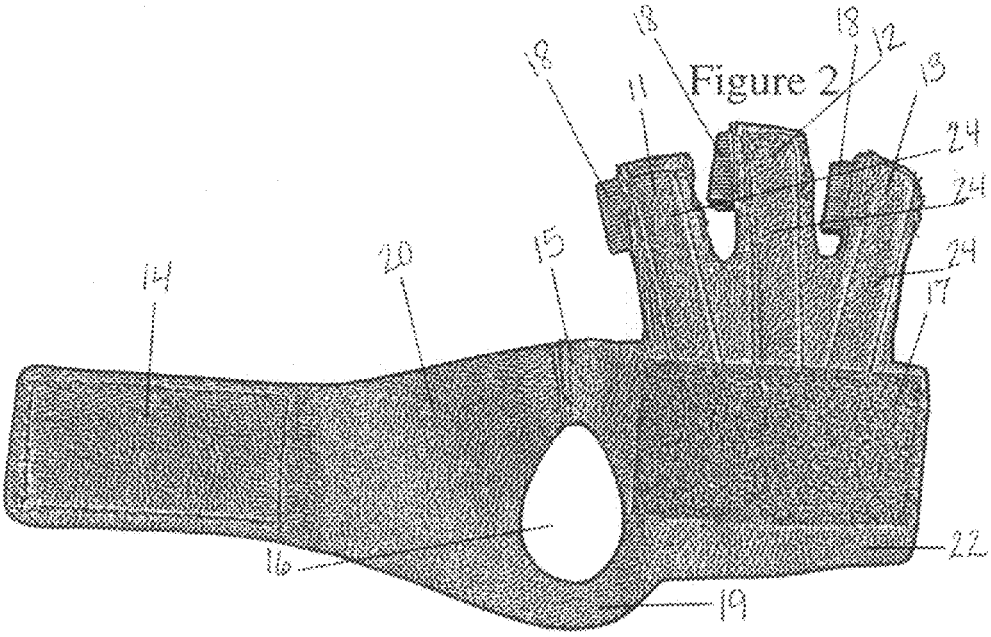
FIG. 2 is a top view of the device spread out its entire length.

FIG. 2 shows the lay out version of the device. This includes a space to insert the thumb and palm 16, allowing the strap 14 to wrap around the underside of the hand. After placing the glove 31 on top of the hand and inserting the thumb 16, the strap will wrap around the bottom of hand 20, then securely and conventionally fastens to the top of the glove with hook and loop material 17. The bottom edge of the device will wrap around the bottom side of palm 19 just above the wrist joint 10. The outer material of the glove 31 is connected at a point 15 between the thumb slot 16 and index finger 11.

FIG. 3 shows the bottom view of a worn device. The material runs below the finger pads of the hand 26 and toward the bottom of the hand 19, around the thumb and palm at the point of the wrist 10. The glove material is connected at the inside of the hand between the thumb and index finger 15, allowing complete movement of the thumb joint 16. Finger straps 18 for the fingers 11 12 13, consist of a stretchable material located between the digits of the fingers. This material 18 can be braided elastic, knitted elastic, hook and loop, neoprene, vinyl, naugahyde, or leather applications. The function of the straps 18 is to anchor the glove to the top of the hand which will prevent finger flexion at release of the shot.

FIG. 4 shows the undercarriage of the glove 21 consisting of a material that can be neoprene, vinyl, hook and loop, naugahyde, cordura, or leather applications. The undercarriage 21 houses the splint support material 24. The splint support material 24 is wedged tightly between the undercarriage 21 and top of the glove material. Therefore, the material for the top of the glove is connected to the undercarriage 21. The splint support material can include wood, stainless steel, aluminum, plastic, rubber, or metals.

The angle of the splint support material 24 provides the separation between fingers that is crucial to proper shooting. The splint support material 24, also prevents finger flexion at the base 28 of fingers 11 12 13 on the follow through of the shot. This is because the splint material runs from the top of fingers 11 12 13 toward the bottom of hand 22. The strap 14 wraps around the bottom of the hand and connects to the top of the hand 17 (FIG. 2) by hook and loop fastening material 27.

Figure 5:
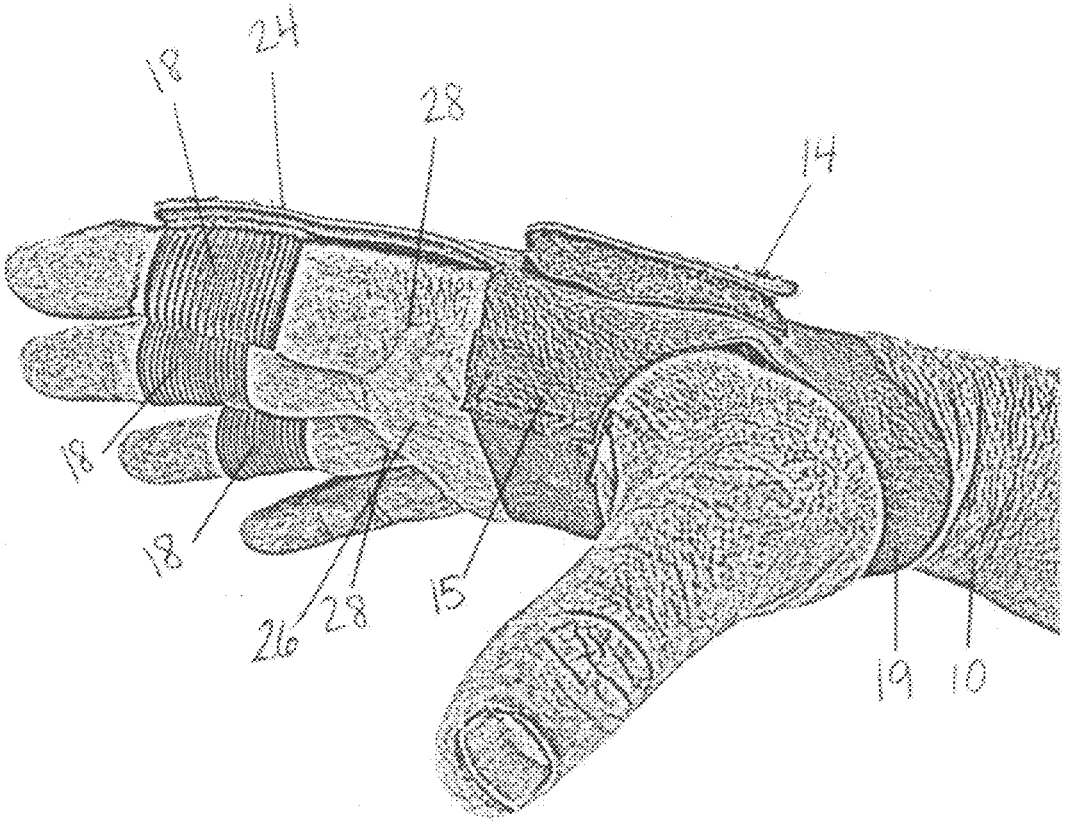
FIG. 5 is a left side view of a hand (right) wearing the device.

FIG. 5 shows the side view of a worn glove on the right hand. The bottom edge of glove 19 wraps around the top part of the thumb and the base of the palm without hindering the wrist 10. Stretchable material 18 wraps around the digits of the fingers 11 12 13, in order to prevent finger flexion at the base of the fingers 28. The stretchable material 18 attaches to the undercarriage 21 of the glove, as well as the material at the top of the glove 31.

Figure 6:
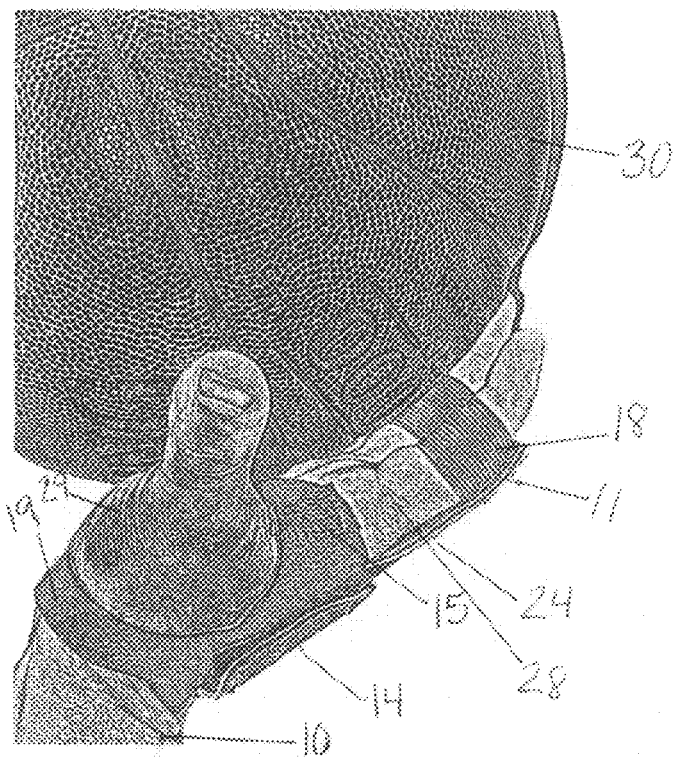
FIG. 6 shows the incorrect set up position for the basketball shot (right hand).
Figure 7:
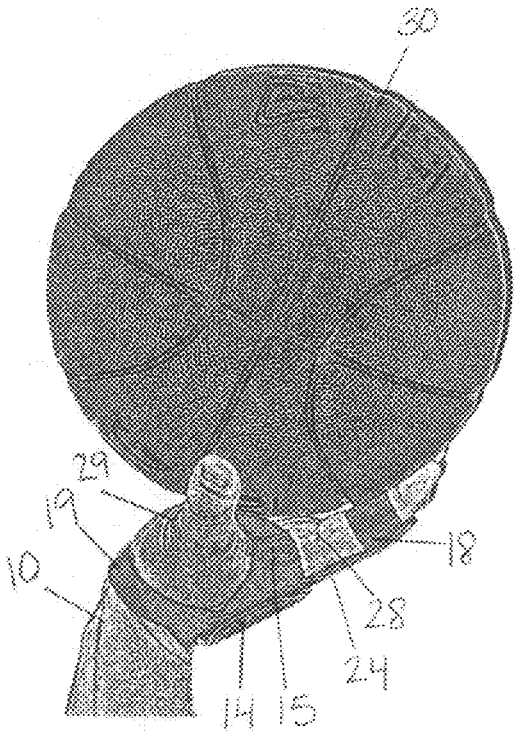
FIG. 7 shows the correct set up position for the basketball shot (right hand).

FIG. 6 shows the incorrect set up form for a basketball shot. The wrist 10 has insufficient extension, resulting in loss of power by the shooter. If the wrist 10 is not sufficiently extended in proper position, the device will cause the index finger 11 to be raised off the ball 30 since the finger splints 24 prevents improper finger flexion. With the ball 30 improperly raised off the index finger 11, the ball 30 will incorrectly rest on the palm 29. Unlike prior art, the design of the splint material 24 is made in such a way that it not only prevents wrist flexion on the shot release, but also promotes perfect wrist extension on every shot set up. FIG. 7 shows the correct wrist 10 extension angle, which forces the index finger 11 to be in contact with the ball 30. In turn, the ball will be resting on the finger pads 28 and fingertips 11 12 13 and not on the palm 29.

Figure 8:
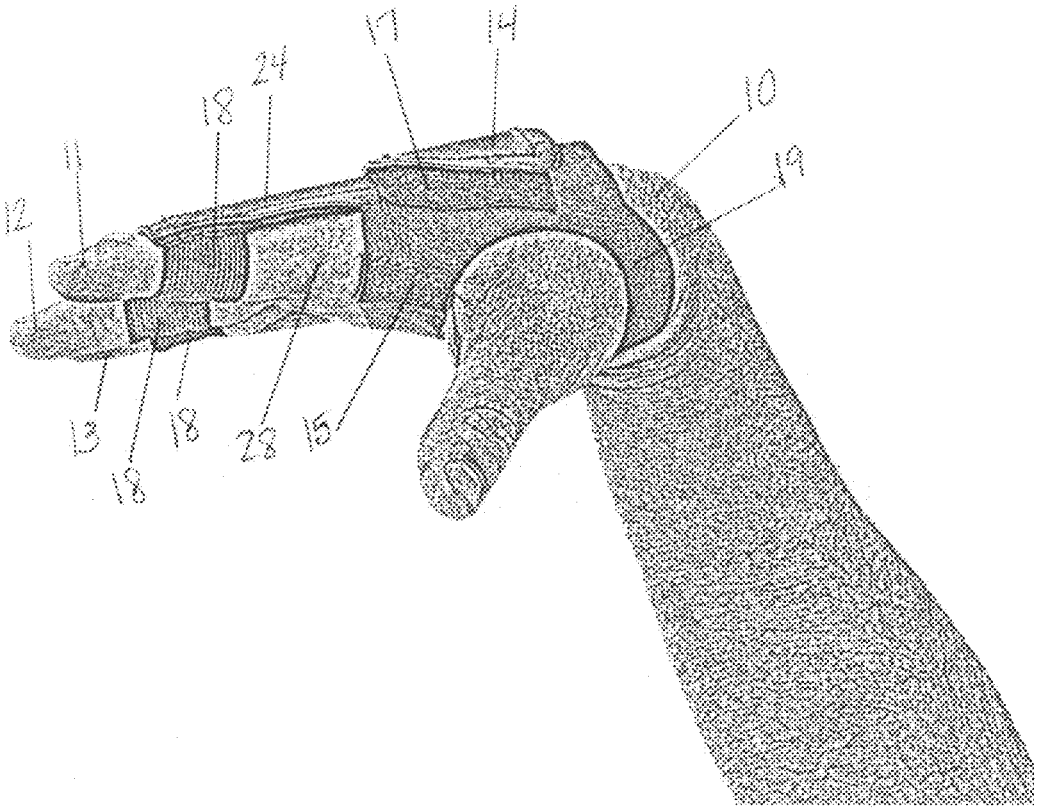
FIG. 8 is the correct position on the basketball shot follow through (right hand).

FIG. 8 shows the correct follow through of the basketball shot. The wrist 10 finishes in full flexion, with an open hand and fingers 11 12 13 held in extension, pointing directly toward the basketball hoop. The flexible material 18 prevents flexion of the fingers 11 12 13 at the base of hand 28, in order to create the proper finish for the basketball shot. The bottom part of the glove wraps around the bottom side of thumb 19, but is curved upward on the bottom part of the top of hand 22. This is designed intentionally as to not hinder wrist flexion or extension on the shot release.

I claimed:

1. A glove used to allow a basketball player to perfect his or her shooting skill, comprising a hand portion having a base area abutting the dorsum of the player's hand when the glove is worn, said hand portion including two longitudinal spines, each of said longitudinal spines extending from said base area of said hand portion toward the tip of a finger, when the glove is worn on the player's hand, a restraining device connected to each of said longitudinal spines, each of said restraining devices encircling a portion of one of the player's fingers, when the glove is worn on the player's hand, said restraining devices preventing finger flexion at the release of a basketball shot;

a band connected to said hand portion having an aperture through which a thumb may pass, said band substantially encloses the palm of the player's hand, when said band is wrapped around said base area; and an undercarriage attached to the underside of said hand portion, said undercarriage provided with two rigid splint members within said undercarriage, each of said rigid splint members aligned with one of said longitudinal spines.

2. The glove in accordance with claim 1 further including a third longitudinal spine extending from said base area of said hand portion toward the tip of a third finger when the glove is worn on the player's hand, and a third restraining device connected to said third longitudinal spine encircling a portion of the third finger.

3. The glove in accordance with claim 2 further including a longitudinal splint member attached to each longitudinal spine facing the dorsum of the player's hand, when the glove is worn, said splint members providing separation between the player's fingers at the release of the basketball shot.

4. The glove in accordance with claim 2 wherein said restraining devices are constructed from an elastic material.

5. The glove in accordance with claim 2 wherein said restraining devices encircle the middle of the PIP joint of the player's fingers when the glove is worn on the player's hand.

6. The training glove according to claim 1 wherein said band is a generally linear strap having engaging connections means at opposing ends.

7. The training glove according to claim 6 wherein the engaging connection means is hook and loop fastening material at the opposing ends of the linear strap.

8. The training glove according to claim 3 wherein the proximal end of the substantially rigid elongated splint members is disposed substantially aligned with the center of the aperture of the said band.

9. The training glove according to claim 1 wherein said undercarriage is fabricated from a stretchable fabric bonded foamed elastomer.

10. The training glove according to claim 1 wherein said band is fabricated from a material selected from the group consisting of neoprene, vinyl, naugahyde and leather applications.

* * * * *